US008545964B2

(12) United States Patent
Svirklys

(10) Patent No.: US 8,545,964 B2
(45) Date of Patent: Oct. 1, 2013

(54) ROLL-FORM SHOCK AND DRAINAGE PAD FOR OUTDOOR FIELD INSTALLATIONS

(76) Inventor: Fred Svirklys, Bolton (CA)

( * ) Notice: Subject to any disclaimer, the term of this patent is extended or adjusted under 35 U.S.C. 154(b) by 457 days.

(21) Appl. No.: 12/889,071

(22) Filed: Sep. 23, 2010

(65) Prior Publication Data

US 2012/0076979 A1 Mar. 29, 2012

(51) Int. Cl.

| | |
|---|---|
| ***B32B 3/24*** | (2006.01) |
| ***B32B 3/30*** | (2006.01) |
| ***B32B 5/18*** | (2006.01) |
| *E01C 13/02* | (2006.01) |
| *E01C 13/10* | (2006.01) |
| *E04F 15/16* | (2006.01) |

(52) U.S. Cl.

USPC ..... 428/134; 428/131; 428/136; 428/156; 428/158; 428/167; 428/220; 428/314.4; 428/314.8; 428/906; 52/408; 472/92

(58) Field of Classification Search

None

See application file for complete search history.

(56) References Cited

U.S. PATENT DOCUMENTS

| | | | | |
|---|---|---|---|---|
| 3,126,978 | A * | 3/1964 | Bergstrom | 181/290 |
| 3,577,894 | A * | 5/1971 | Emerson et al. | 404/31 |
| 3,655,501 | A * | 4/1972 | Tesch | 428/136 |
| 3,687,021 | A | 8/1972 | Hensley | |
| 3,795,180 | A * | 3/1974 | Larsen | 405/36 |
| 3,978,263 | A | 8/1976 | Wellensiek | |
| 4,307,879 | A | 12/1981 | McMahon et al. | |
| 4,505,960 | A | 3/1985 | Leffingwell | |
| 4,572,700 | A | 2/1986 | Mantarro et al. | |
| 4,896,404 | A | 1/1990 | Garner | |
| 4,946,719 | A | 8/1990 | Dempsey | |
| 5,352,158 | A * | 10/1994 | Brodeur, Jr. | 472/92 |
| 5,395,467 | A | 3/1995 | Rogers, Jr. | |
| 5,489,317 | A | 2/1996 | Bergevin | |

(Continued)

FOREIGN PATENT DOCUMENTS

| | | | |
|---|---|---|---|
| DE | 3513611 | A1 * | 10/1986 |
| EP | 0 185 645 | A2 | 6/1986 |

(Continued)

OTHER PUBLICATIONS

Artificial Turk Shock Pad [online] [retrieved Sep. 2, 2010]. Retrieved from the Internet: <URL: http://www.trocellen.com/en/artificial-turf>. 1 page.

(Continued)

*Primary Examiner* — David Sample
*Assistant Examiner* — Jeff Vonch
(74) *Attorney, Agent, or Firm* — Alston & Bird LLP

(57) ABSTRACT

A unitary roll-form shock and drainage pad for an outdoor field installation is formed by a continuous length of shock-absorbing polymer foam sheet. The sheet has a plurality of grooves in its lower surface, the grooves extending continuously along the length of the foam sheet and being spaced apart across the width of the foam sheet, each groove having a crest defining a maximum penetration of the groove through the thickness of the foam sheet. The foam sheet further defines a plurality of rows of vertically extending holes extending from the upper surface of the sheet toward the lower surface, the holes in each row being spaced apart along the length of the foam sheet and being aligned with a respective one of the grooves such that the holes extend into the crest of the groove. A plurality of elongate through-going slots radiate out from each of at least some of the holes.

12 Claims, 4 Drawing Sheets

(56) References Cited

U.S. PATENT DOCUMENTS

| | | | | |
|---|---|---|---|---|
| 5,586,408 | A | 12/1996 | Bergevin | |
| 5,617,687 | A * | 4/1997 | Bussey et al. | 52/404.2 |
| 5,724,916 | A * | 3/1998 | Brodie et al. | 119/525 |
| 5,850,708 | A | 12/1998 | Bergevin | |
| 5,908,673 | A | 6/1999 | Muhlberger | |
| 6,221,445 | B1 | 4/2001 | Jones | |
| 6,805,936 | B2 | 10/2004 | Seaton | |
| 6,818,274 | B1 | 11/2004 | Buck et al. | |
| 6,858,272 | B2 | 2/2005 | Squires | |
| 7,081,283 | B2 | 7/2006 | Straughn | |
| 7,166,340 | B1 | 1/2007 | Clark | |
| 7,244,477 | B2 | 7/2007 | Sawyer et al. | |
| 7,249,913 | B2 | 7/2007 | Linville | |
| 7,452,586 | B2 * | 11/2008 | Vershum | 428/137 |
| 7,585,555 | B2 | 9/2009 | Stroppiana | |
| 2005/0238433 | A1 | 10/2005 | Daluise | |
| 2005/0281963 | A1 | 12/2005 | Cook | |
| 2006/0045995 | A1 * | 3/2006 | Dipple | 428/17 |
| 2006/0084513 | A1 * | 4/2006 | De Vries et al. | 472/92 |
| 2007/0062139 | A1 * | 3/2007 | Jones et al. | 52/403.1 |
| 2007/0077393 | A1 * | 4/2007 | Chiang et al. | 428/131 |
| 2007/0137139 | A1 * | 6/2007 | Tierney et al. | 52/748.1 |
| 2007/0193149 | A1 * | 8/2007 | Chang | 52/302.1 |
| 2007/0252301 | A1 | 11/2007 | Svirklys | |
| 2008/0176010 | A1 * | 7/2008 | Sawyer et al. | 428/27 |
| 2008/0240860 | A1 | 10/2008 | Ianniello | |
| 2009/0246418 | A1 | 10/2009 | Wise | |
| 2009/0272696 | A1 | 11/2009 | Simon et al. | |
| 2010/0041488 | A1 | 2/2010 | Foxon et al. | |

FOREIGN PATENT DOCUMENTS

| | | | |
|---|---|---|---|
| EP | 435050 | A1 * | 7/1991 |
| EP | 601396 | A2 * | 6/1994 |
| EP | 1842963 | A1 * | 10/2007 |
| JP | 2-195910 | A | 8/1990 |
| JP | 10155675 | A * | 6/1998 |
| NL | 8900860 | A * | 7/1990 |
| WO | WO 9747184 | A1 * | 12/1997 |
| WO | WO 02/076560 | A2 | 10/2002 |
| WO | WO 2008/046912 | A1 | 4/2008 |
| WO | WO 2009/015795 | A1 | 2/2009 |
| WO | WO 2009/098006 | A1 | 8/2009 |

OTHER PUBLICATIONS

Artificial Turf Shock Pad Sport [online] [retrieved Sep. 2, 2010]. Retrieved from the Internet: <URL: http://www.trocellen.com/en/component/content/article/37-sport-and-industry/206-artificial- . . . >. 1 page.

* cited by examiner

ROLL-FORM SHOCK AND DRAINAGE PAD FOR OUTDOOR FIELD INSTALLATIONS

BACKGROUND OF THE INVENTION

The present application relates generally to materials for installation in outdoor fields such as sports fields, playgrounds, and the like, for providing shock absorption for persons engaged in activities on the field and for facilitating drainage of rainfall from the field.

In an outdoor field of the above-noted type, typically the earth substrate is first graded to a suitable slope that will allow water to drain toward drain pipes installed in certain locations adjacent the field. A drainage layer (e.g., an aggregate such as gravel) is installed above the earth substrate, and a shock-absorbing layer is then installed above the drainage layer. A synthetic turf product can then be installed atop the shock-absorbing layer. There are many variations of such installations, but a common factor among many of them is the substantial labor and time required for installing them, which is due in large part to the complexity of having separate drainage and shock-absorbing components that must be installed sequentially.

Attempts have been made to provide a unitary drainage and shock-absorbing device for outdoor field installations, although with limited success. For example, U.S. Patent Application Publication 2005/0238433 published on Oct. 27, 2005 describes one embodiment of a drainage blanket consisting of a core having a base and a plurality of upstanding cup-like studs extending therefrom, a top sheet covering the top of the core, two side sheets on opposite side edges of the core, and an optional bottom sheet on the bottom of the core. The top sheet has holes that allow water to drain into the core, where the water can then flow horizontally through the spaces between the studs, the water exiting through passages at the ends of the drainage blanket. The '433 publication describes another exemplary embodiment of the drainage blanket as consisting of a high-density polyethylene core of fused, entangled filaments sandwiched between a needle-punched non-woven geotextile on one side and a head-bonded non-woven geotextile on the other side. The '433 publication further indicates that the drainage blanket can be constructed to provide shock attenuation, but includes no description as to how to do so, particularly for an installation such as a sports field where adequate shock attenuation is especially critical.

The complexity of construction of the drainage blankets described in the '433 publication would be expected to make them too costly for practical use in outdoor field installations of large dimensions. The embodiment having the core with upstanding studs and a geotextile top sheet is believed to be commercialized under the trademark PRODRAIN™ by Global Synthetics. The ProDrain 6000 and ProDrain CD12 products have thicknesses of 10 and 12 mm, respectively, and come in widths of about 1 meter and lengths of 15 meters and 25 meters, respectively, which lengths presumably are the practical upper limit for the manufacturing process by which the products are made. These lengths are too short for covering the entire width of a sports field such as a soccer field, and therefore multiple pieces would be required to span the width of the field, and thus seams would be needed. Furthermore, these products would not provide the degree of shock absorption needed in a sports field because the core is a molded impervious plastic article of high crush-resistance.

U.S. Pat. No. 6,818,274 describes an artificial turf system that in one embodiment includes a shock-attenuating pad that includes one or more drainage channels in its lower surface. The pad is described as being a recycled closed-cell polyethylene foam sheet. Such a foam sheet is formed of shredded particles of polyethylene foam that are bonded together to form the sheet. Vertical drainage through such a sheet depends entirely on the interstitial spaces between the foam particles, which means that it is difficult to precisely tailor the vertical drainage performance of the sheet to meet a given vertical drainage requirement. Also, some water will pass through portions of the sheet in between the drainage channels and will have to flow between the bottom surface of the sheet and the substrate in order to reach one of the drainage channels, which is undesirable. Shock absorption and thickness across the area of the recycled foam sheet tends to be somewhat non-uniform because of the bonded-particle construction of the sheet and the fact that the particles are of different densities and material composition. This results in non-uniform expansion and/or contraction of the particles during sheet construction. Additionally, the recycled foam sheet has a relatively high basis weight and thus in long lengths is somewhat difficult to handle and maneuver on the installation site.

What is needed is a unitary shock and drainage pad for outdoor field installations that provides excellent drainage and shock absorption, that has a uniform thickness and uniform shock-absorption properties across its area, and that can be economically manufactured in any desired length (i.e., a roll-form shock and drainage pad) so as to reduce the number of seams needed in a large field installation. A reduced basis weight relative to the above-described recycled foam sheet is also desirable.

BRIEF SUMMARY OF THE DISCLOSURE

The present disclosure describes a unitary shock and drainage pad that meets the above-noted needs and achieves further advantages as described below. By "unitary" is meant that the pad is not formed of discrete particles of foam bonded together but rather is an integrally formed foam article. Furthermore, the shock and drainage pad is a roll-form article, meaning that it has a continuous (indefinite) length of any desired value and is rolled into a roll for shipping and storage.

In one embodiment, the unitary shock and drainage pad comprises a continuous length of flexible shock-absorbing polymer foam sheet rolled into a roll, the foam sheet having a generally planar upper surface and a generally planar lower surface when the foam sheet is unrolled and laid flat on a planar horizontal surface. A thickness of the foam sheet defined between the upper and lower surfaces is substantially uniform and ranges from about 5 mm to about 50 mm. The foam sheet can have any desired width, which typically would lie in the range from about 1200 mm to about 1828 mm.

The foam sheet defines a plurality of grooves in the lower surface, the grooves extending continuously along the length of the foam sheet and being spaced apart across the width of the foam sheet. Each groove has a crest defining a maximum penetration of the groove through the thickness of the foam sheet.

The foam sheet defines a plurality of rows of vertically extending holes extending from the upper surface toward the lower surface, the holes in each row being spaced apart along the length of the foam sheet and being aligned with a respective one of the grooves such that the holes extend into the crest of the groove. The holes have a diameter substantially exceeding an average cell size of the foam sheet (i.e., the holes are macroscopic in scale, as opposed to the much smaller scale of the cells of the foam).

The holes can be circular in cross-section, or can have any of various other cross-sectional shapes, including elliptical, oval, polygonal, etc.

Because the holes extend into the crests of the grooves, the vertical distance that water must flow in order to reach the grooves is minimized, thereby facilitating drainage at high rates.

In a preferred embodiment, the sheet includes a plurality of slots that extend entirely through the thickness of the sheet and that radiate out from at least some of the holes. As used herein, the term "slot" means an aperture that extends through the sheet thickness and that has a length dimension substantially exceeding a width dimension of the aperture. As used herein, "substantially exceeding" means that the length of the slots is at least about five times the width of the slots. The slots can have a length from about 10 mm to about 30 mm, and a width from about 0 mm to about 5 mm.

As an example, each hole that includes the slots can have the slots arranged in a cross-shaped or star-shaped configuration radiating out from the hole. In one embodiment, there are four slots per hole, spaced apart 90° in a cross-shaped configuration, and the slots extend parallel to the foam sheet's length and width directions.

In one embodiment, all of the holes include the slots.

The slots can help reduce or prevent irregular expansion or contraction of the sheet caused by excessive temperature fluctuation during installation.

Suitably, the diameter of the holes can be about 3 mm to about 15 mm, and more preferably about 5 mm to about 10 mm.

The grooves can have a width at the lower surface of about 5 mm to about 30 mm, and more preferably about 10 mm to about 20 mm. The average depth of the grooves (from the sheet's lower surface to the crest of the groove) is from about 2 mm to about 15 mm, with the proviso that the groove depth does not exceed about 30% of the sheet thickness.

The holes collectively can have a percent open area from about 1% to about 10% based on 1 $m^2$ of the foam sheet. The grooves collectively can have a percent open area from about 5% to about 35% based 1 $m^2$ of the foam sheet. The percent open area of the grooves advantageously is at least 10 times the percent open area of the holes.

The foam sheet can be formed of a polymer foam having a density from about 2 lbs/$ft^3$ to about 15 lbs/$ft^3$. Suitable foams for the sheet include closed-cell foams based on any of various polymers including polyethylene, polypropylene, EVA, or combinations thereof. Such polymers can be non-cross-linked or cross-linked, depending on the needs of the particular application.

The unitary shock and drainage pad can be used in combination with a filter fabric disposed above the pad for preventing fine debris from passing through the holes. In some cases the filter fabric can be bonded to the upper surface of the pad.

BRIEF DESCRIPTION OF THE SEVERAL VIEWS OF THE DRAWING(S)

Having thus described the disclosure of the present application in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
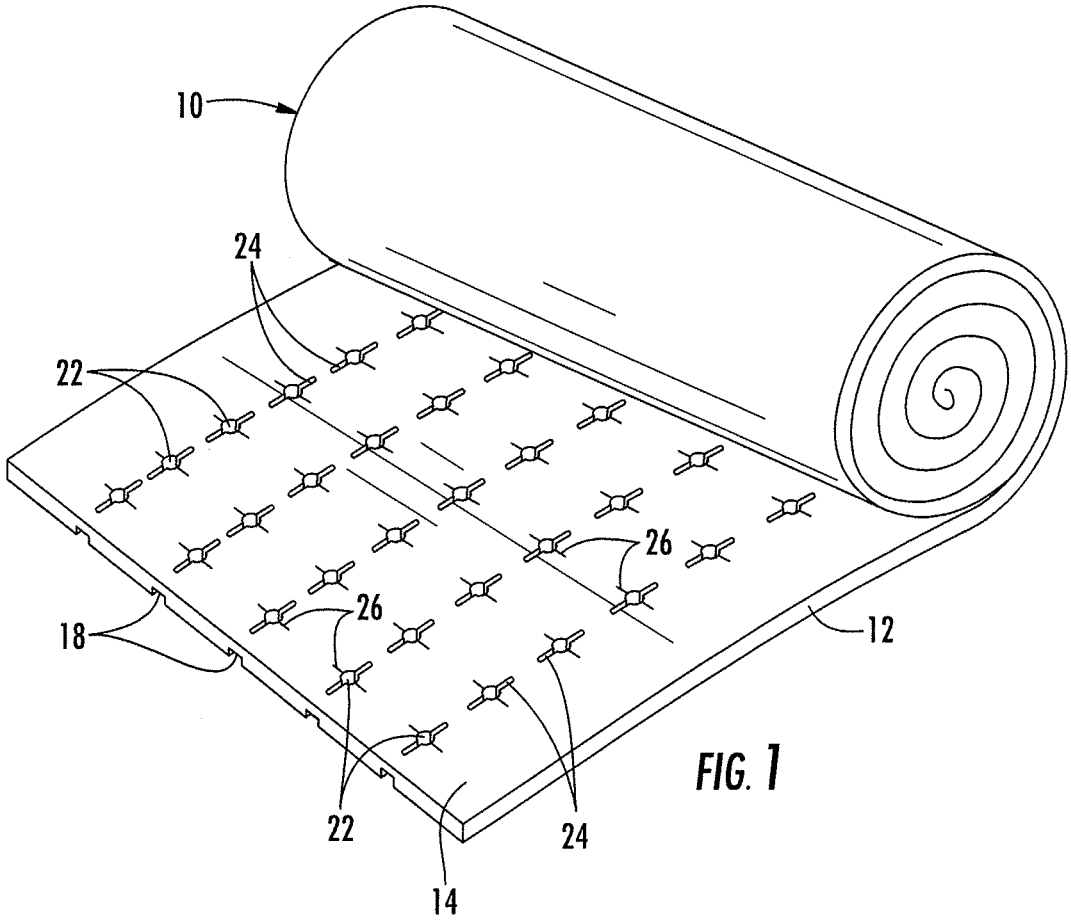
FIG. 1 is a perspective view of a partially unrolled roll of shock and drainage pad in accordance with one embodiment of the present invention.
Figure 2:
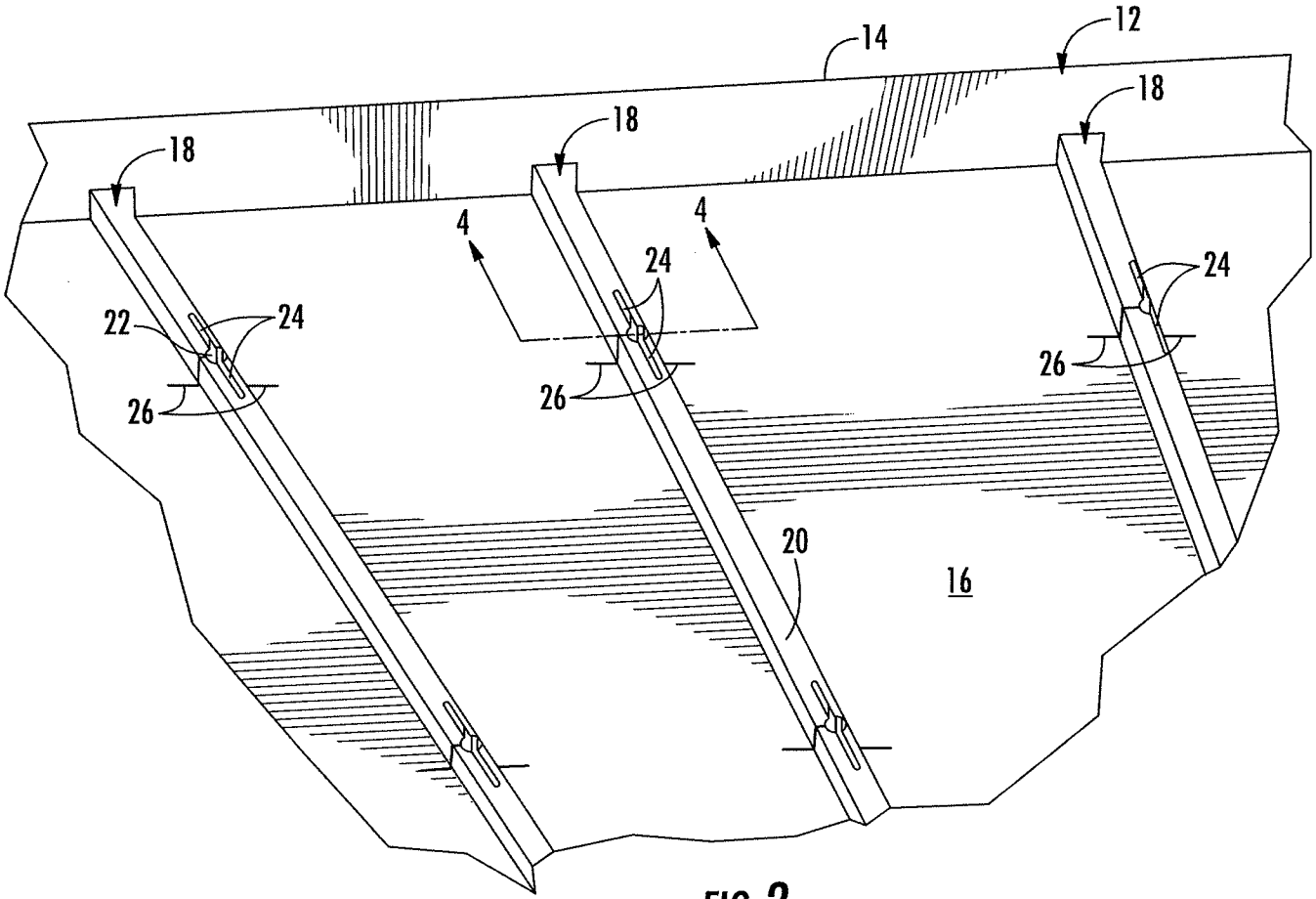
FIG. 2 is a perspective view, generally from below, of a portion of the shock and drainage pad.
Figure 3:
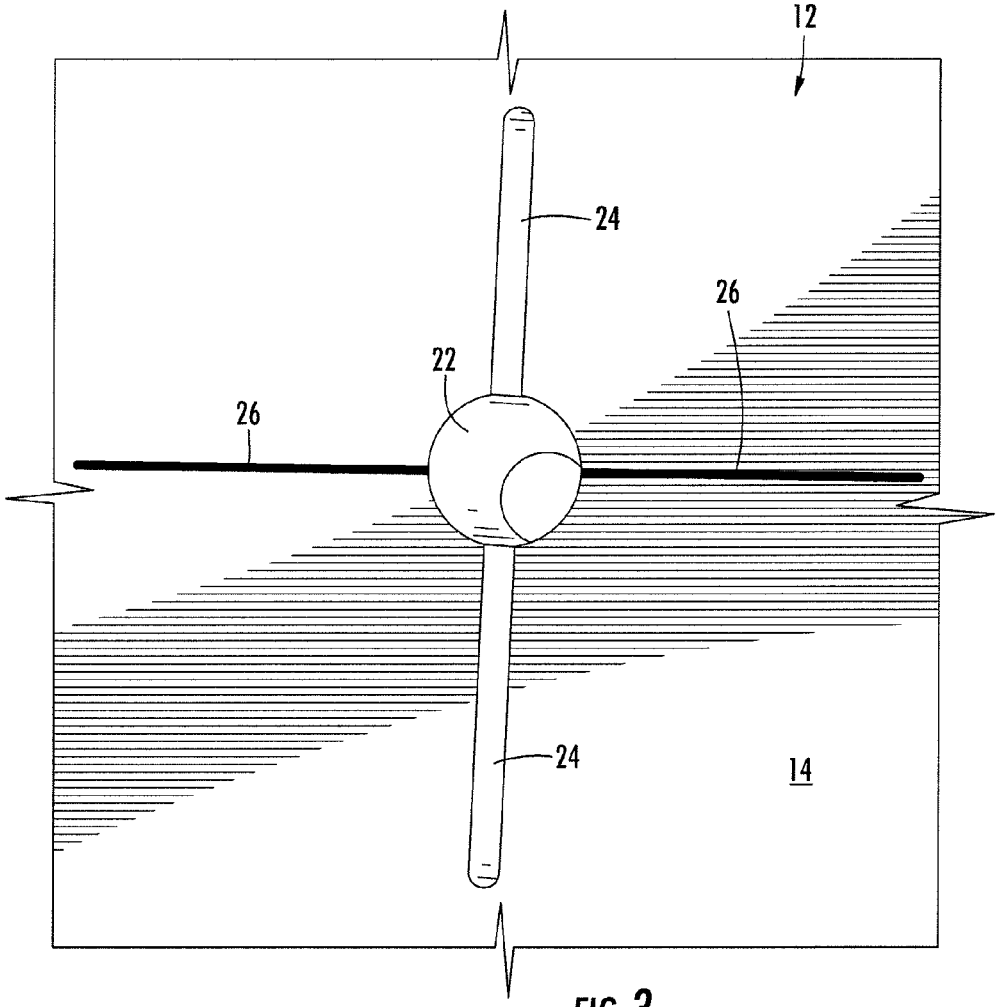
FIG. 3 is a detail view of the one of the holes with its associated slots radiating out therefrom.
Figure 4:
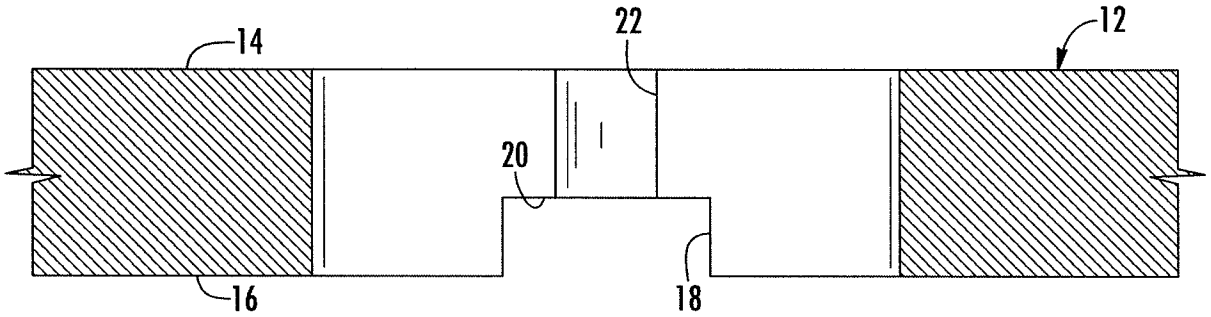
FIG. 4 is a cross-sectional view along line 4-4 in FIG. 2, through one of the holes and its associated slots and groove.

FIGS. 1-4 show a roll 10 of a long continuous shock and drainage pad 12 in accordance with one embodiment of the present invention. The pad 12 comprises a sheet of suitable polymer foam. The foam sheet can be formed of a polymer foam having a density from about 2 lbs/$ft^3$ to about 15 lbs/$ft^3$. Suitable foams for the sheet include closed-cell foams based on any of various polymers including polyethylene, polypropylene, EVA, or combinations thereof. Such polymers can be non-cross-linked or cross-linked, depending on the needs of the particular application.

When the foam sheet 12 is unrolled and laid flat on a planar horizontal surface, the sheet has a generally planar upper surface 14 and a generally planar lower surface 16. A thickness of the foam sheet defined between the upper and lower surfaces is substantially uniform (except for the presence of the grooves) and ranges from about 5 mm to about 50 mm. The foam sheet can have any desired width, which typically would lie in the range from about 1200 mm to about 1828 mm.

The foam sheet 12 defines a plurality of grooves 18 in the lower surface 16, the grooves extending continuously along the length of the foam sheet and being spaced apart across the width of the foam sheet. Each groove 18 has a crest 20 defining a maximum penetration of the groove through the thickness of the foam sheet.

The foam sheet 12 further defines a plurality of rows of vertically extending holes 22 extending from the upper surface 14 toward the lower surface 16. The holes 22 in each row are spaced apart along the length of the foam sheet and are aligned with a respective one of the grooves 18 such that the holes 22 extend into the crest 20 of the groove 18. The holes 22 have a diameter substantially exceeding an average cell size of the foam sheet (i.e., the holes are macroscopic in scale, as opposed to the much smaller scale of the cells of the foam). The holes 22 can be circular in cross-section, or can have any of various other cross-sectional shapes, including elliptical, oval, polygonal, etc.

Because the holes 22 extend into the crests 20 of the grooves 18, the vertical distance that water must flow in order to reach the grooves is minimized, thereby facilitating drainage at high rates.

In a preferred embodiment, the sheet 12 includes a plurality of slots 24 and 26 that extend entirely through the thickness of the sheet and that radiate out from at least some of the holes 22. As used herein, the term "slot" means an aperture that extends through the sheet thickness and that has a length dimension substantially exceeding a width dimension of the aperture. As used herein, "substantially exceeding" means that the length of the slots is at least about five times the width of the slots. The slots can have a length from about 10 mm to about 30 mm, and a width from about 0 mm to about 5 mm.

When a slot has a width of 0 mm, that means that the slot is a simple cut through the foam sheet that does not remove any foam material, whereas when a slot has a non-zero thickness some foam material is removed by the formation of the slot. In the illustrated embodiment, the slots 24 have a non-zero thickness while the slots 26 have a zero thickness, but it will be understood that all of the slots could have a zero thickness or all of the slots could have a non-zero thickness.

In the illustrated embodiment, each hole 22 that includes the slots 24, 26 has the slots arranged in a cross-shaped or star-shaped configuration radiating out from the hole. As illustrated, there are four slots (two slots 24 and two slots 26) per hole, spaced apart 90° in a cross-shaped configuration. The slots 24 extend parallel to the foam sheet's length direction and the slots 26 extend parallel to the width direction.

In one embodiment as shown, all of the holes 22 include the slots 24, 26.

Suitably, the diameter of the holes 22 can be about 3 mm to about 15 mm, and more preferably about 5 mm to about 10 mm.

The grooves 18 can have a width at the lower surface 16 of about 5 mm to about 30 mm, and more preferably about 10 mm to about 20 mm. The average depth of the grooves 18 (from the sheet's lower surface 16 to the crest 20 of the groove) is from about 2 mm to about 15 mm, with the proviso that the groove depth does not exceed about 30% of the sheet thickness.

The holes 22 collectively can have a percent open area from about 1% to about 10% based on 1 $m^2$ of the foam sheet 12. The grooves 18 collectively can have a percent open area from about 5% to about 35% based 1 $m^2$ of the foam sheet. The percent open area of the grooves 18 advantageously is at least 10 times the percent open area of the holes 22.

The unitary shock and drainage pad 12 can be used in combination with a filter fabric (not shown) disposed above the pad for preventing fine debris from passing through the holes 22. In some cases the filter fabric can be bonded to the upper surface 14 of the pad.

The present invention thus provides a unitary shock and drainage pad 12 for outdoor field installations that has excellent drainage and shock absorption characteristics, that has a uniform thickness and uniform shock-absorption properties across its area, and that can be economically manufactured in any desired length (i.e., a roll-form shock and drainage pad) so as to reduce the number of seams needed in a large field installation. The pad also has a relatively low basis weight relative to the above-described recycled foam sheet, so manipulation of long lengths of the pad during installation can be easily managed.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A shock and drainage pad in roll form, comprising:

a continuous length of flexible shock-absorbing polymer foam sheet rolled into a roll, the foam sheet having a generally planar upper surface and a generally planar lower surface when the foam sheet is unrolled and laid flat on a planar horizontal surface, a thickness of the foam sheet being defined between the upper and lower surfaces, the thickness being from about 5 mm to about 50 mm, the foam sheet having a width from about 1200 mm to about 1828 mm;

the foam sheet defining a plurality of grooves in the lower surface, the grooves consisting only of lengthwise grooves extending continuously along the length of the foam sheet and being spaced apart across the width of the foam sheet, each groove having a crest defining a maximum penetration of the groove through the thickness of the foam sheet;

the foam sheet defining a plurality of rows of vertically extending holes extending from the upper surface toward the lower surface, each hole having an outer periphery defining a diameter of the hole, the holes in each row being spaced apart along the length of the foam sheet and being aligned with a respective one of the grooves such that the holes extend into the crest of the groove, wherein the holes have a diameter substantially exceeding an average cell size of the foam sheet; and the foam sheet further defining a plurality of slots extending entirely through the thickness of the foam sheet, the slots being arranged such that a plurality of slots radiate out from the outer periphery of each of at least some of the holes, each slot having a length dimension and a width dimension, the length of the slots being at least about five times the width of the slots.

2. The shock and drainage pad of claim 1, wherein the slots have a length from about 10 mm to about 30 mm, and a width from about 0 mm to about 5 mm.

3. The shock and drainage pad of claim 1, wherein each hole that includes the slots has the slots arranged in a cross-shaped or star-shaped configuration radiating out from the hole.

4. The shock and drainage pad of claim 3, wherein there are four slots per hole, spaced apart 90° in a cross-shaped configuration, and the slots extend parallel to the foam sheet's length and width directions.

5. The shock and drainage pad of claim 4, wherein all of the holes include the slots.

6. The shock and drainage pad of claim 1, wherein the diameter of the holes is about 3 mm to about 15 mm.

7. The shock and drainage pad of claim 6, wherein the grooves have a width at the lower surface of about 5 mm to about 30 mm.

8. The shock and drainage pad of claim 1, wherein the holes collectively have a percent open area from about 1% to about 10% based on 1 $m^2$ of the foam sheet.

9. The shock and drainage pad of claim 8, wherein the grooves collectively have a percent open area from about 5% to about 35% based on 1 $m^2$ of the foam sheet, and the percent open area of the grooves is at least 10 times the percent open area of the holes.

10. The shock and drainage pad of claim 1, wherein the foam sheet is formed of a polymer foam having a density from about 2 $lbs/ft^3$ to about 15 $lbs/ft^3$.

11. The shock and drainage pad of claim 1, wherein the foam sheet is a closed-cell foam formed of a polymer selected from the group consisting of polyethylene, polypropylene, EVA, and combinations thereof.

12. The shock and drainage pad of claim 11, wherein the polymer is cross-linked.

* * * * *